US007974426B2

(12) United States Patent
Park

(10) Patent No.: US 7,974,426 B2
(45) **Date of Patent: *Jul. 5, 2011**

(54) IC CHIP TYPE HEARING AID MODULE FOR MOBILE COMMUNICATION TERMINAL

(75) Inventor: Book-sung Park, Seoul (KR)

(73) Assignee: Pantech & Curitel Communications, Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/635,951

(22) Filed: Dec. 11, 2009

(65) Prior Publication Data

US 2010/0128908 A1 May 27, 2010

Related U.S. Application Data

(63) Continuation of application No. 11/301,841, filed on Dec. 12, 2005, now Pat. No. 7,657,046.

(30) Foreign Application Priority Data

Feb. 25, 2005 (KR) ..... 10-2005-0016126

(51) Int. Cl.
*H04R 25/00* (2006.01)

(52) U.S. Cl. ..... 381/312; 381/317; 381/321

(58) Field of Classification Search ..... 381/312, 381/317, 320, 321, 331, 71.6, 74, 101–104, 381/106, 107; 379/52, 443, 444; 333/172
See application file for complete search history.

(56) References Cited

U.S. PATENT DOCUMENTS 1,792,523 A 2/1931 Zobel
3,396,245 A * 8/1968 Flygstad ..... 381/331
3,578,913 A 5/1971 Ufkes
5,138,665 A 8/1992 Ito
5,574,792 A 11/1996 Konno
5,740,257 A * 4/1998 Marcus ..... 381/71.6
6,925,179 B2 * 8/2005 Waldron et al. ..... 379/443
7,657,046 B2 * 2/2010 Park ..... 381/312

FOREIGN PATENT DOCUMENTS

FR 706.006 6/1931
GB 407405 3/1934
JP 52-038863 3/1977

OTHER PUBLICATIONS

European Search Report dated Oct. 1, 2009 by the European Patent Office in European Patent Application No. 05257810.1. Notice of Allowance dated Aug. 28, 2009 (for co-pending patent U.S. Appl. No. 11/301,841).

* cited by examiner

*Primary Examiner* — Huyen D Le
(74) *Attorney, Agent, or Firm* — H.C. Park & Associates, PLC

(57) ABSTRACT

Disclosed is an IC chip type hearing aid module for use in a mobile communication terminal having a hearing aid circuit including: a first section having a resistor R1 and an inductor L1 which are connected in series on a first output line Receiver_P between the mobile communication terminal and an ear speaker; a second section having a resistor R4 and an inductor L2 which are connected in series on a second output line Receiver_N between the mobile communication terminal and the ear speaker; a third section having a resistor R2 and a capacitor C2 which are connected in series between an input terminal of the first section and an output terminal of the second section; and a fourth section having a resistor R3 and a capacitor C3 which are connected in series between an input terminal of the second section and an output terminal of the first section.

9 Claims, 11 Drawing Sheets

IC CHIP TYPE HEARING AID MODULE FOR MOBILE COMMUNICATION TERMINAL

CROSS-REFERENCE TO RELATED APPLICATIONS

This application is a continuation of U.S. patent application Ser. No. 11/301,841, filed on Dec. 12, 2005, and claims the priority of Korean Patent Application No. 2005-016126, filed on Feb. 25, 2005, in the Korean Intellectual Property Office, the disclosure of which are incorporated herein in their entirety by reference.

BACKGROUND OF THE INVENTION

1. Field of the Invention

The present invention relates to a hearing aid module for use in a mobile communication terminal.

2. Discussion of the Background

Mobile communication terminals equipped with hearing aid function for the hard-of-hearing have been increasingly demanded. According to FCC (Federal Communications Commission) regulation in the United States, mobile communication terminals equipped with no hearing aid function are not permitted to be sold since the year 2001 in the United States.

A hearing aid is a device used to help the hard-of-hearing hear sounds better. It includes a telecoil (T-coil) which is a coil of wire that is switched in place of a hearing aid microphone to allow the hearing aid to pickup the varying magnetic field at an earpiece of a telephone handset. The T-coil is essentially one half of a transformer, the other half being provided by the handset or an induction loop in a listening assistance system.

FIG. 1 is a schematic diagram of an ear speaker according to the prior art. An ear speaker 10 includes a permanent magnet 11 generating a magnetic field, a pole piece 12 forming a magnetic circuit in cooperation with the permanent magnet 11, a voice coil 13 wound around the permanent magnet 11 and the pole piece 12, a vibrating plate 14 provided over the pole piece 12, and a frame 15 and a cover 16 which cover the permanent magnet 11, the pole piece 12, the voice coil 13, and the vibrating plate 14. The ear speaker 10 is connected to an ear microphone of a mobile communication terminal (not shown) through a connecting terminal 17 to output an audio signal from the mobile communication terminal through the ear speaker 10.

In the ear speaker 10, the permanent magnet 11 generates a static magnetic field. When an audio signal is input from the mobile communication terminal, current flows through the voice coil 13. The current generates a dynamic magnetic field, thereby generating a Lorentz force. At this time, since the audio signal is an alternating current, its polarity is changed at very short intervals of approximately $1/1000$ sec. The change in the polarity of the current causes the direction of Lorentz force to be changed, thereby creating forces of attraction and repulsion.

The magnitude of Lorentz force is proportional to the magnitude of flux density, the amount of current, and the length of the voice coil 13. The direction of Lorentz force is a direction perpendicular to a plane formed by the flux density and the current. Accordingly, the vibrating plate 14 moves up and down due to the Lorentz force, thereby producing a sound.

FIG. 2 is a Schematic diagram of an ear speaker with hearing aid function according to the prior art. The ear speaker 10 includes a hearing aid coil (T-coil) 18 inside the cover 16. As shown in FIG. 2, a Plurality of layers of the hearing aid coil 18 is provided over the voice coil 13 to produce a leakage magnetic field, thereby providing improved hearing performance.

In more detail, part of the magnetic field produced by the voice coil 13 leaks out of the ear speaker 10. The magnetic field produced by the voice coil 13 causes an induced electromotive force to be produced on the hearing aid coil 18. The electromotive force has the same frequency as but different magnitude from the audio signal inputted to the ear speaker 10.

Accordingly, since both an acoustic signal outputted from the voice coil 13 and an acoustic signal caused by the electromotive force induced on the hearing aid coil 18 are outputted from the ear speaker 10 with hearing aid function, the hard-of-hearing can hear sounds better through the ear speaker 10 with hearing aid function than through a typical ear speaker.

The ear speaker 10 with hearing aid function has a much larger impedance than a typical ear speaker with no hearing aid function to allow the hard-of-hearing to hear sounds better.

FIG. 9 is a frequency-response characteristic graph of an ear speaker with hearing aid function according to the prior art.

To increase the impedance of the ear speaker 10, the coil has to be thicker, the number of turns of the coil has to be increased, and the ear speaker itself has to be thicker to meet an optimum resonance condition.

However, there is a problem in that such a large-sized ear speaker is not convenient to use. Further, an ear microphone that allows a user to hear and input sounds is recently more popular than the ear speaker, so that it is more difficult to incorporate the hearing aid function into the ear microphone than the ear speaker.

SUMMARY

The exemplary embodiments of the present invention provide an IC (integrated circuit) chip type hearing aid module for use in a mobile communication terminal capable of adjusting the gain of an output signal according to the degree of hardness of hearing so that general users, the hard-of-hearing, and the very-hard-of-hearing can hear the audio signal well.

According to an exemplary embodiment of the present invention, there is provided an IC chip type hearing aid module for use in a mobile communication terminal having a hearing aid circuit including: a first section having a resistor and an inductor which are connected in series on a first output line between the mobile communication terminal and an ear speaker; a second section having a resistor and an inductor which are connected in series on a second output line between the mobile communication terminal and the ear speaker; a third section having a resistor and a capacitor which are connected in series between an input terminal of the first section and an output terminal of the second section; and a fourth section having a resistor and a capacitor which are connected in series between an input terminal of the second section and an output terminal of the first section.

The hearing aid circuit may further include a filter which is connected between the output terminals and/or the input terminals of the first and second sections.

The IC chip type hearing aid module may further include noise removing sections which are connected to the output terminals or input terminals of the first and second sections.

The IC chip type hearing aid module may further include a gain adjusting section which is connected to the input terminals of the first and second sections and outputs a signal amplified through an induction loop amplification operation according to the gain setting from a user.

The gain adjusting section may include: a plurality of switches for gain setting; two amplifiers each having two input terminals and an output terminal, the output terminals being connected to the input terminals of the first and second sections, a non-inverting one of the input terminals of one of the amplifiers and an inverting one of the input terminals of the other amplifier being connected to a ground terminal, and the switches being connected in parallel between the remaining input terminals of the amplifiers and the output terminals of the amplifiers; and a plurality of resistors which are connected between the switches and the output terminals of the two amplifiers.

The gain adjusting section may further include impedance adjusting sections each of which has a capacitor and a resistor connected in series and which are respectively connected to the input terminals of the two amplifiers which have different polarities from each other.

The IC chip type hearing aid module may further include switches which are respectively connected to the output terminals of the first and second sections to connect/disconnect between the hearing aid circuit and the ear speaker.

According to another exemplary embodiment of the present invention, there is provided a mobile communication terminal equipped with the IC chip type hearing aid module.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE ILLUSTRATED EMBODIMENTS

Exemplary embodiments in accordance with the present invention will now be described in detail with reference to the accompanying drawings.

Figure 1:
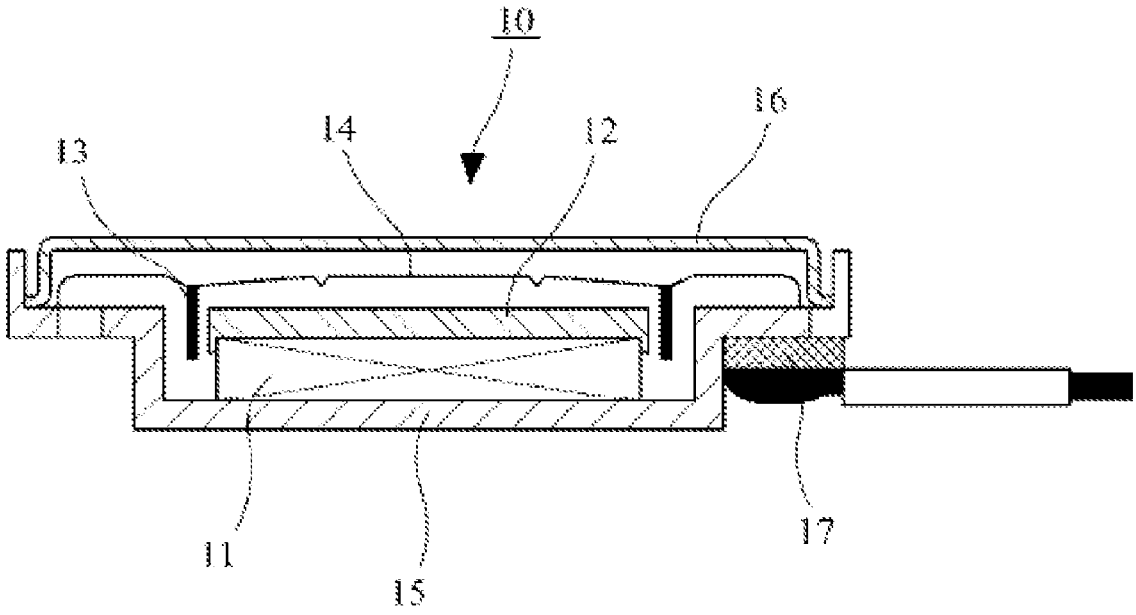
FIG.1 (PRIOR ART)
FIG. 1 is an example of an ear speaker according to the prior art.
Figure 2:
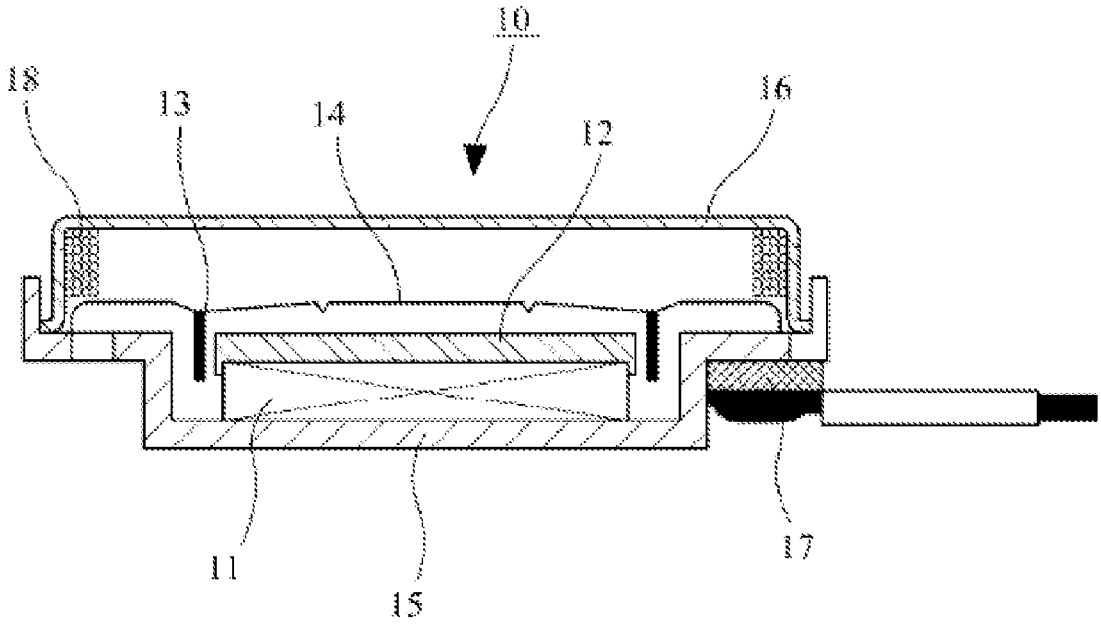
FIG.2 (PRIOR ART)
FIG. 2 is an example of an ear speaker with hearing aid function according to the prior art.
Figure 3:
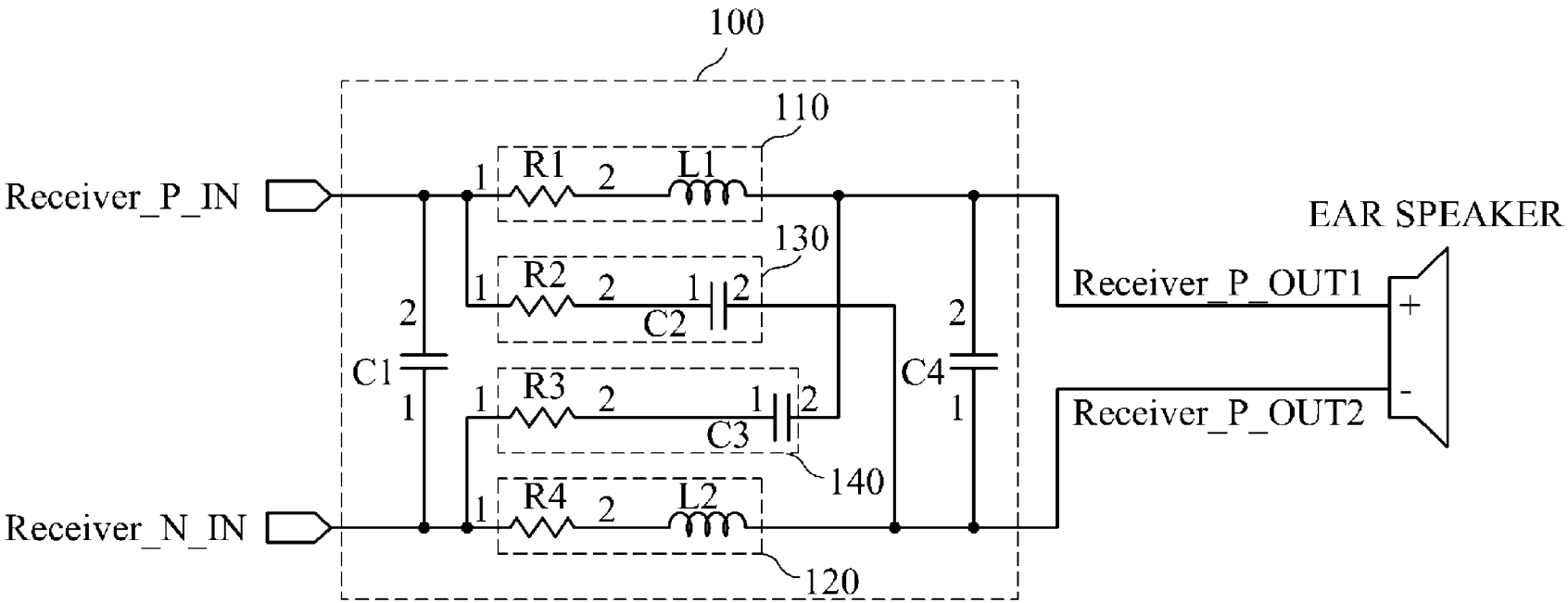
FIG. 3 is an IC chip type hearing aid module for use in a mobile communication terminal according to a first embodiment of the present invention.

FIG. 3 is an integrated circuit (IC) chip type hearing aid module for use in a mobile communication terminal according to a first embodiment of the present invention.

The hearing aid module includes a hearing aid circuit 100. The hearing aid circuit 100 includes a first section 110, a second section 120, a third section 130, and a fourth section 140.

The first section 110 is an RL serial circuit having a resistor R1 and an inductor L1, which are connected in serial on a first output line Receiver_P between a mobile communication terminal and an ear speaker. An alternating current (AC) audio signal inputted from the mobile communication terminal is output through the first output line Receiver_P to the ear speaker. Due to impedance formed by the resistor R1 and the inductor L1, a magnetic intensity produced in the ear speaker is increased so that the hard-of-hearing can hear sounds better.

The second section 120 is an RL serial circuit having a resistor R4 and an inductor L2, which are connected in serial on a second output line Receiver_N between the mobile communication terminal and the ear speaker. An AC audio signal inputted from the mobile communication terminal is output through the second output line Receiver_N to the ear speaker. Due to impedance formed by the resistor R3 and the inductor L2, a magnetic intensity produced in the ear speaker is increased so that the hard-of-hearing can hear sounds better.

The first output line Receiver_P and the second output line Receiver_N are preferably connected to left and right speakers of the ear speaker, respectively.

The third section 130 is an RC serial circuit having a resistor R2 and a capacitor C2, which are connected in serial between an input terminal of the first section 110 and an output terminal of the second section 120. A tolerance generated by mutual interference between the inductor Li of the first section 110 and the inductor L2 of the second section 120 is compensated by the resistor R2. At this time, the capacitor C2 transmits the AC audio signal while blocking a direct current (DC) signal.

The fourth section 140 is an RC serial circuit having a resistor R3 and a capacitor C3, which are connected in serial between an input terminal of the second section 120 and an output terminal of the first section 110. A tolerance generated by mutual interference between the inductor L2 of the second section 120 and the inductor Li of the first section 110 is compensated by the resistor R3. At this time, the capacitor C3 transmits the AC audio signal while blocking a DC signal.

Accordingly, when the AC audio signal inputted from the mobile communication terminal is output to the ear speaker through the first section 110 and the second section 120, the magnetic intensity produced in the ear speaker is increased due to the impedance formed by the resistor R1 and the inductor L1, and the tolerance generated by mutual interference between the first section 110 and the second section 120 is compensated by the resistors of the third section 130 and the fourth section 140. As a result, the hard-of-hearing can hear sounds better. Such an IC chip type hearing aid module according to an exemplary embodiment of the present invention for use in a mobile communication terminal is mounted on the mobile communication terminal internally or externally to output the audio signal inputted from the mobile communication terminal to the ear speaker. When the audio signal is output, the magnetic intensity of the ear speaker is compensated so that to the hard-of-hearing can hear sounds better.

Meanwhile, the hearing aid module according to the exemplary embodiment of the present invention may further include a filter C4 connected between output terminals of both the first section 110 and the second section 120.

In addition, the hearing aid module may further include a filter C1 connected between input terminals of both the first section 110 and the second section 120.

The audible frequency range of the human ear is from roughly 20 Hz up to 20 kHz, while the frequency range audible to the human ear through the mobile communication terminal is from approximately 4 kHz up to 5 kHz. Accordingly, each filter C1, C4 regards a signal with frequencies of up to 4 kHz as a noise at the input/output terminals of both the first and second sections 110 and 120 and thus filters out the signal.

For example, suppose that the impedance is about 150Ω in an ear speaker with hearing aid function according to the prior art. In the exemplary embodiment, when the resistors R1 and R4 are set to about 125Ω, the resistors R2 and R3 are about 175Ω, the capacitors C1 and C4 are about 0.012 μF, the inductors L1 and L2 are about 0.340 mH, and the impedance caused by the ear speaker is about 32Ω, the ear speaker of the exemplary embodiment can achieve the same effect as the that of the prior art.

Figure 4:
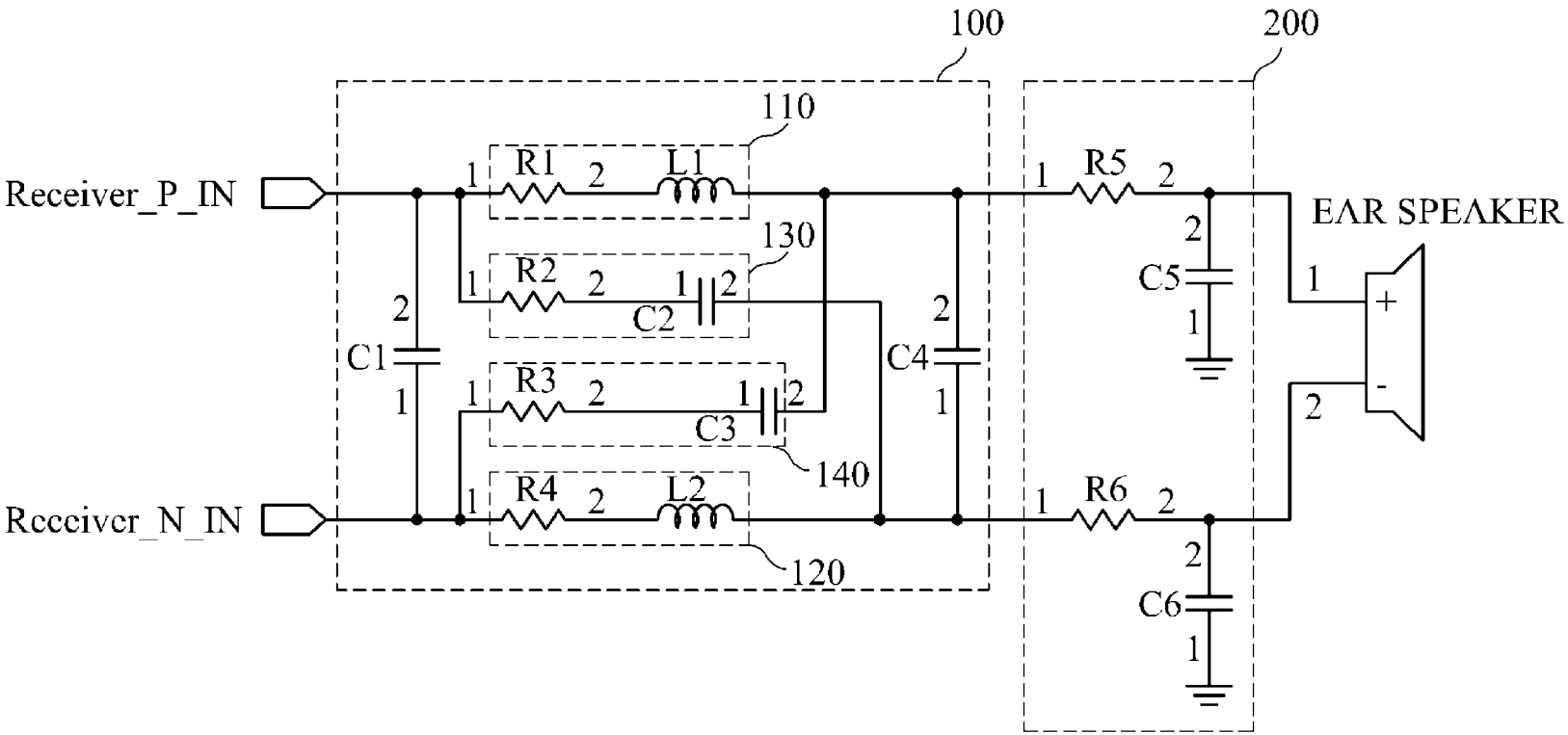
FIG. 4 is an IC chip type hearing aid module for use in a mobile communication terminal according to a second embodiment of the present invention.

FIG. 4 is an IC chip type hearing aid module for use in a mobile communication terminal according to a second embodiment of the present invention.

The hearing aid module according to the second embodiment further includes a noise removing section 200, which is connected to the output terminals of both the first and second sections 110 and 120, in addition to the hearing aid circuit 100 depicted in FIG. 3.

The audible frequency range of the human ear is from roughly 20 Hz up to 20 kHz, while the frequency range audible to the human ear through the mobile communication terminal is from approximately 4 kHz up to 5 kHz. Accordingly, the noise removing section 200 regards a signal with frequencies more than 5 kHz as a noise at the output terminals of both the first and second sections 110 and 120 and thus filters out the signal.

Figure 5:
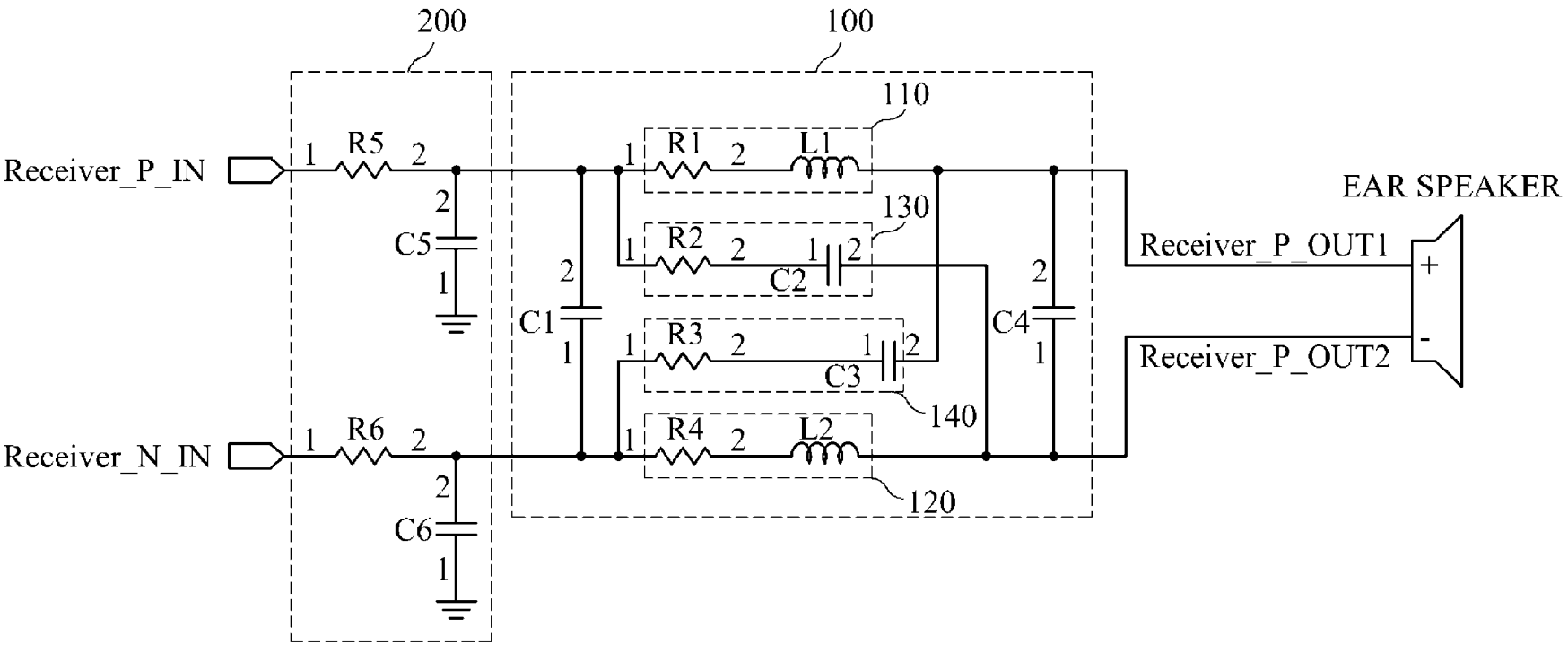
FIG. 5 is an IC chip type hearing aid module for use in a mobile communication terminal according to a third embodiment of the present invention.

FIG. 5 is an IC chip type hearing aid module for use in a mobile communication terminal according to a third embodiment of the present invention.

The hearing aid module according to the third embodiment further includes a noise removing section 200, which is connected to the input terminals of both the first and second sections 110 and 120, in addition to the hearing aid circuit 100 depicted in FIG. 3.

The audible frequency range of the human ear is from roughly 20 Hz up to 20 kHz, while the frequency range audible to the human ear through the mobile communication terminal is from approximately 4 kHz up to 5 kHz. Accordingly, the noise removing section 200 regards a signal with frequencies more than 5 kHz as a noise at the input terminals of both the first and second sections 110 and 120 and thus filters out the signal.

Figure 6:
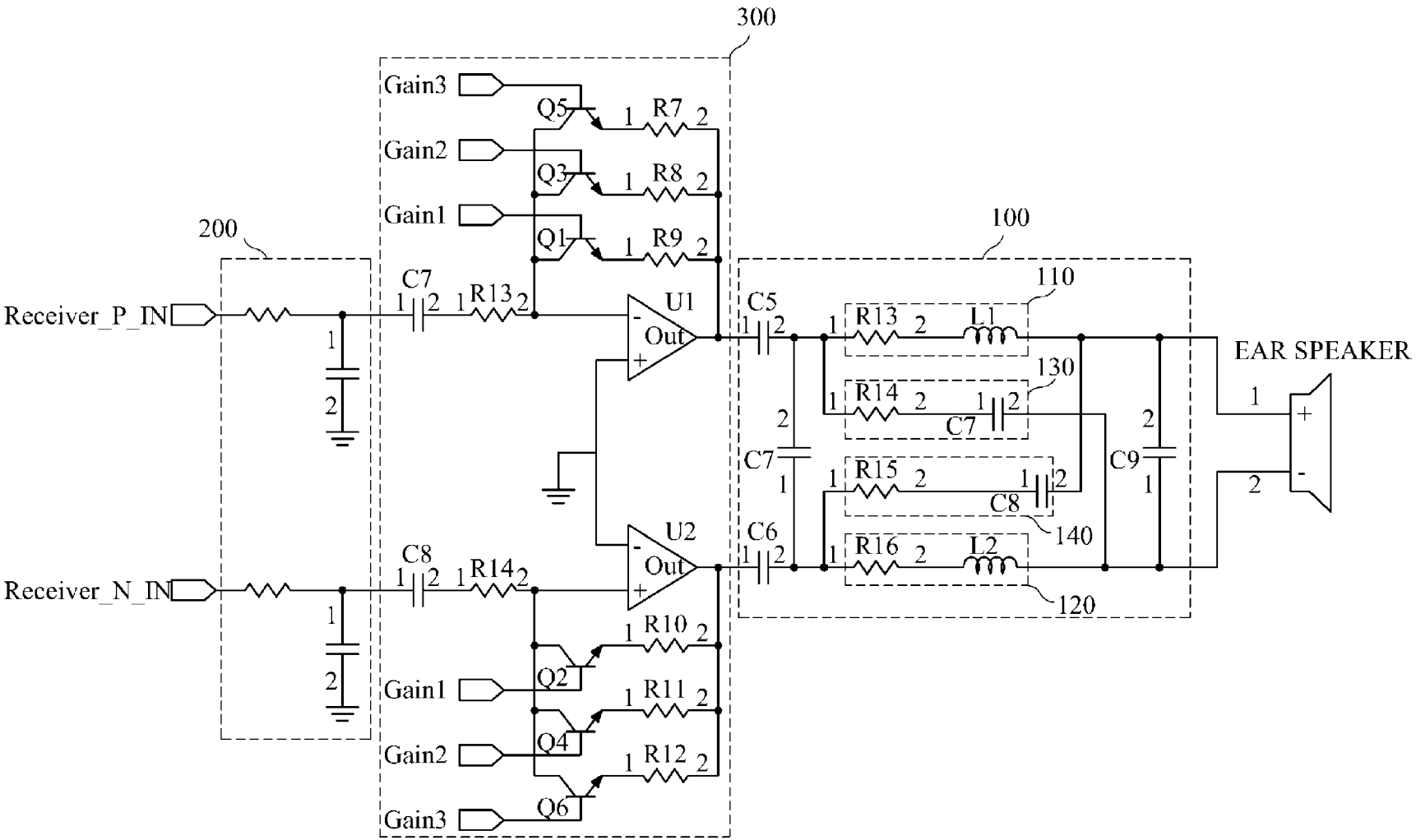
FIG. 6 is an IC chip type hearing aid module for use in a mobile communication terminal according to a fourth embodiment of the present invention.
Figure 7:
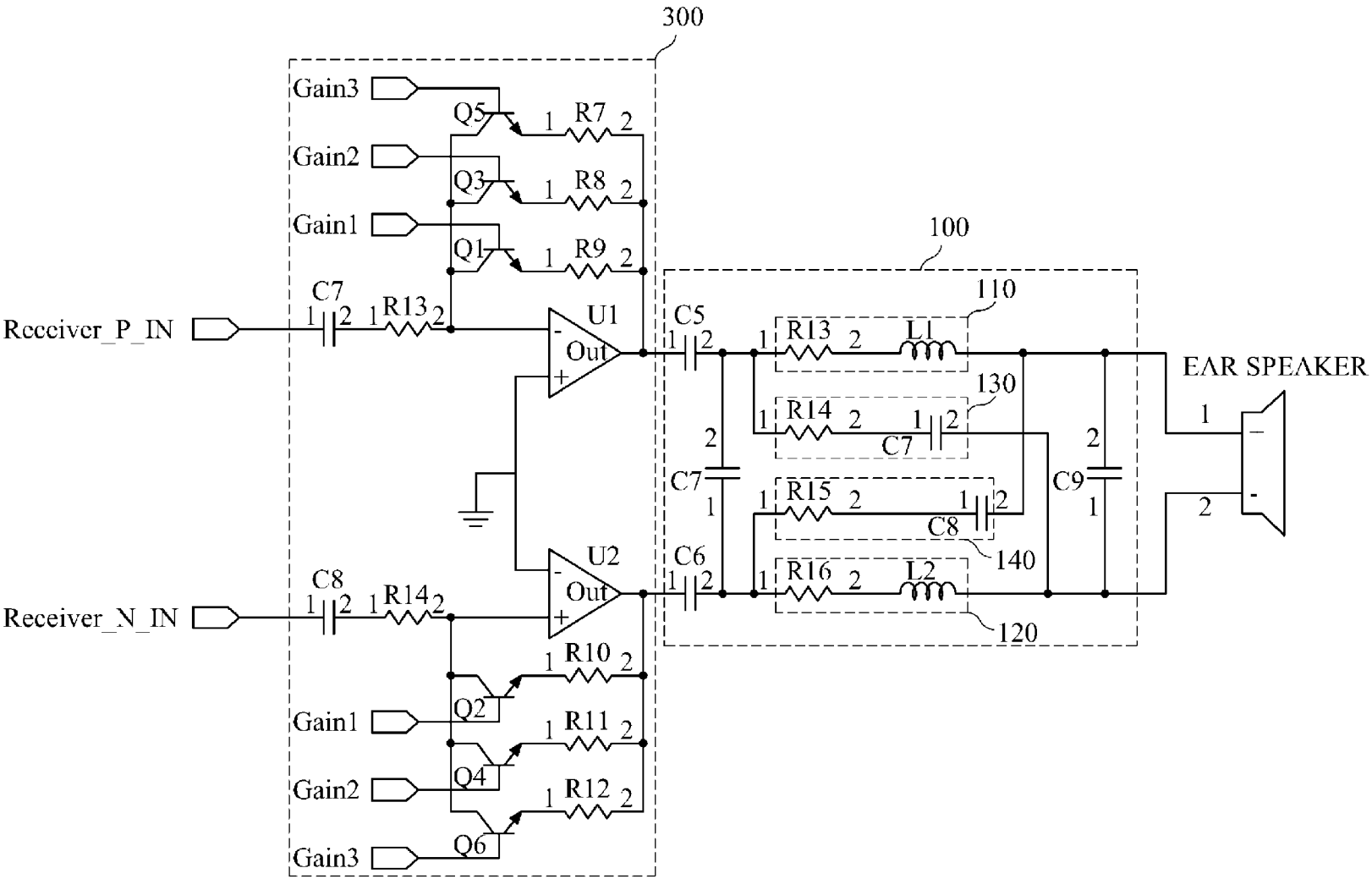
FIG. 7 is an IC chip type hearing aid module for use in a mobile communication terminal according to a fifth embodiment of the present invention.

FIG. 6 is an IC chip type hearing aid module for use in a mobile communication terminal according to a fourth embodiment of the present invention. FIG. 7 is an IC chip type hearing aid module for use in a mobile communication terminal according to a fifth embodiment of the present invention. The hearing aid modules according to the fourth and fifth embodiments further include a gain adjusting section 300.

The gain adjusting section 300 is connected to input terminals of both the first section 110 and the second section 120, and outputs a signal amplified through an induction loop amplification operation according to the gain setting from a user.

That is, the gain adjusting section 300 adjusts the gain of an output signal according to the degree of hardness of hearing so that general users, the hard-of-hearing, and the very-hard-of-hearing can hear the audio signal well.

The gain adjusting section 300 includes a plurality of switches Q1, Q2, Q3, Q4, Q5, Q6, two amplifiers U1, U2, and a plurality of resistors R7, R8, R9, R10, R11, R12.

The switches Q1, Q2, Q3, Q4, Q5, Q6 are elements for performing a gain setting operation to selectively control the gain of an audio signal outputted to the ear speaker. Gain1 denotes a mode for the general users, Gain2 denotes a mode for the hard-of-hearing, and Gain3 denotes a mode for the very-hard-of-hearing.

Accordingly, when using a system according to an exemplary embodiment of the present invention, the general users can push a switch corresponding to Gain1, the hard-of-hearing can push a switch corresponding to Gain2, and the very-hard-of-hearing can push a switch corresponding to Gain3.

Two amplifiers U1, U2 are connected to input terminals of both the first section 110 and the second section 120 at their output terminals. A non-inverting input terminal of one of the amplifiers U1, U2 and an inverting input terminal of the other are connected to a ground terminal. A plurality of switches Q1, Q2, Q3, Q4, Q5, Q6 are connected in parallel between the remaining input terminals of the amplifiers U1, U2 and the output terminals of the amplifiers U1, U2. When any one of the switches Q1, Q2, Q3, Q4, Q5, Q6 is selected, an audio signal outputted from a mobile communication terminal is amplified to a signal with a level corresponding to the selected mode.

The resistors R7, R8, R9, R10, R11, R12 are feedback resistors connected between the switches and the output terminals of the amplifiers U1, U2. Accordingly, the gains of the output signals of the amplifiers U1, U2 are adjusted by signals fed back through the resistors.

Meanwhile, the gain adjusting section 300 preferably further includes impedance adjusting sections C7, R13 and C8, R14, which are connected to the input terminals of the amplifiers U1, U2, respectively. Each of the impedance adjusting sections has a capacitor and a resistor connected in series. The resistors R13, R14 are input impedances of the amplifiers U1, U2, and the capacitors C7, C8 block a DC signal from inputting to the amplifiers U1, U2.

Accordingly, since a user can the gain of the audio signal outputted to the ear speaker, the general users, the hard-of-hearing, and the very-hard-of-hearing can hear the audio signal well.

Figure 8:
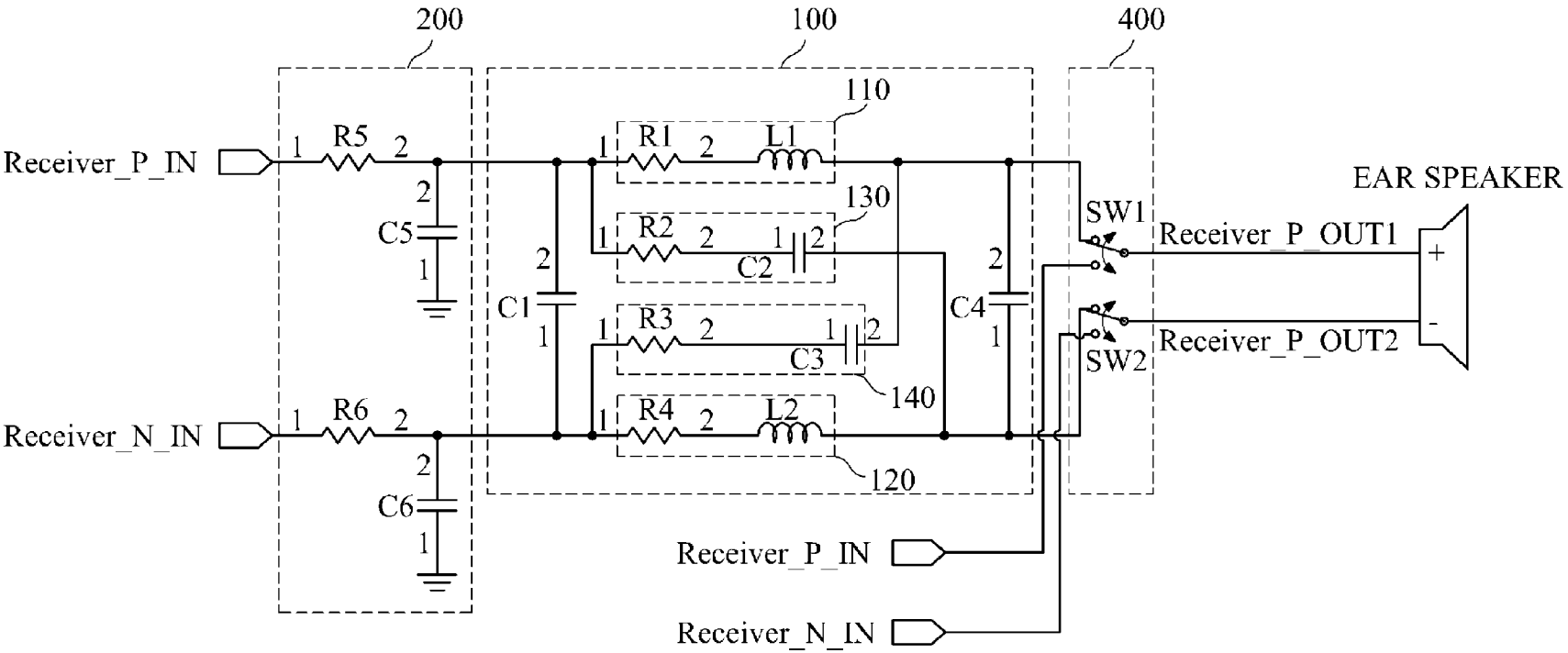
FIG. 8 is an IC chip type hearing aid module for use in a mobile communication terminal according to a sixth embodiment of the present invention.
Figure 9:
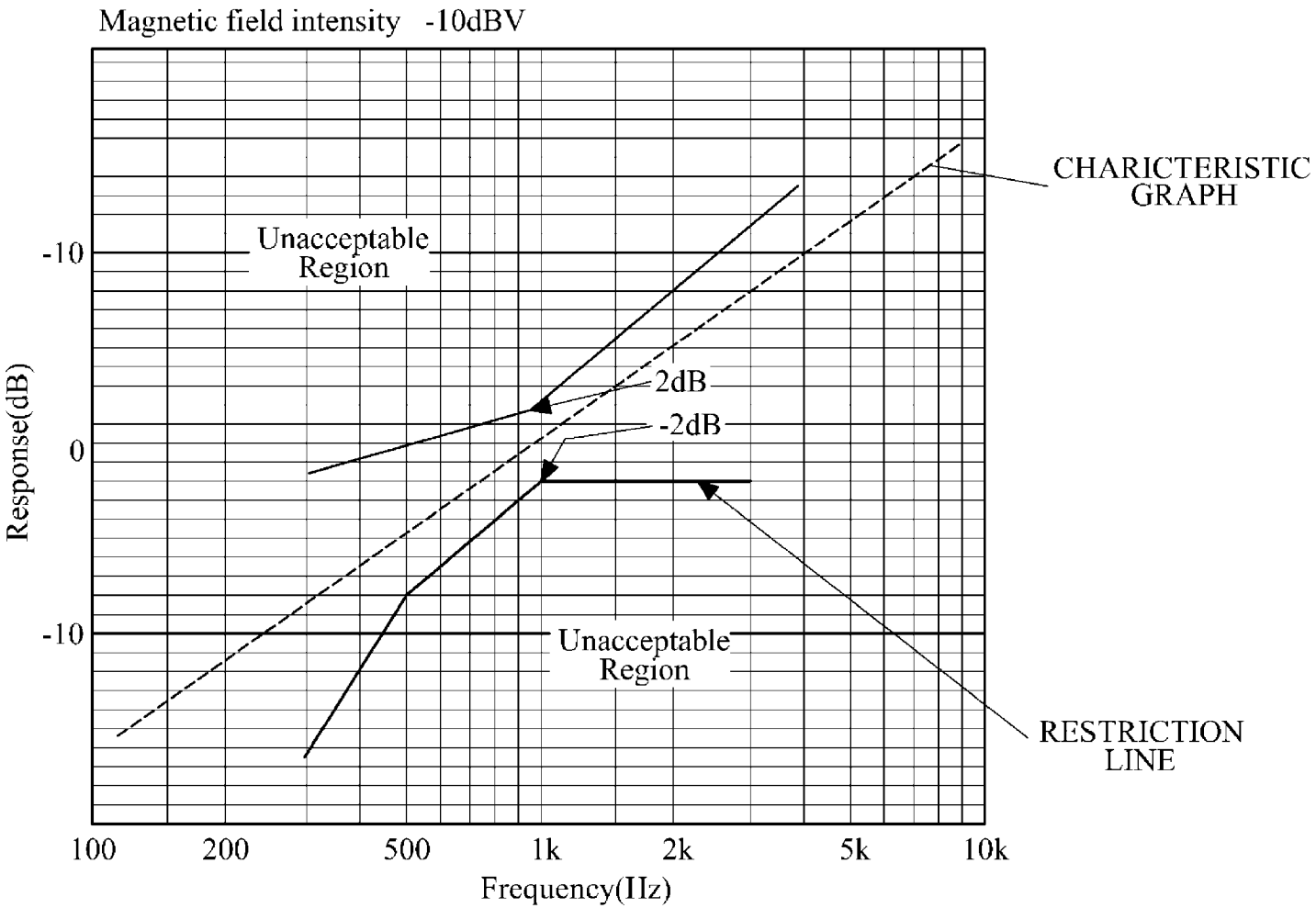
FIG.9 (PRIOR ART)
FIG. 9 is a frequency-response characteristic graph of an ear speaker with hearing aid function according to the prior art.

FIG. 8 is an IC chip type hearing aid module for use in a mobile communication terminal according to a sixth embodiment of the present invention.

The hearing aid module according to the sixth embodiment further includes switches SW1, SW2 400 which are respectively connected to the output terminals of both the first section 110 and the second section 120 to connect/disconnect between the hearing aid circuit and the ear speaker.

The present embodiment is configured such that it is possible to determine whether or not to output the audio signal from the mobile communication terminal to the ear speaker through the IC chip type hearing aid module of the mobile communication terminal by opening/closing the switches SW1 and SW2 connected to the output terminals of both the first section 110 and the second section 120, respectively. The switches SW1, SW2 are preferably configured to switch between the output terminals of both the first section 110 and the second section 120 of the hearing aid circuit 100 and two audio signal input lines which are not connected to the hearing aid module. In this case, the audio signal can be input to the ear speaker through the hearing aid module of the mobile communication terminal, or can be directly input to the ear speaker without passing through the hearing aid module.

Figure 10A:
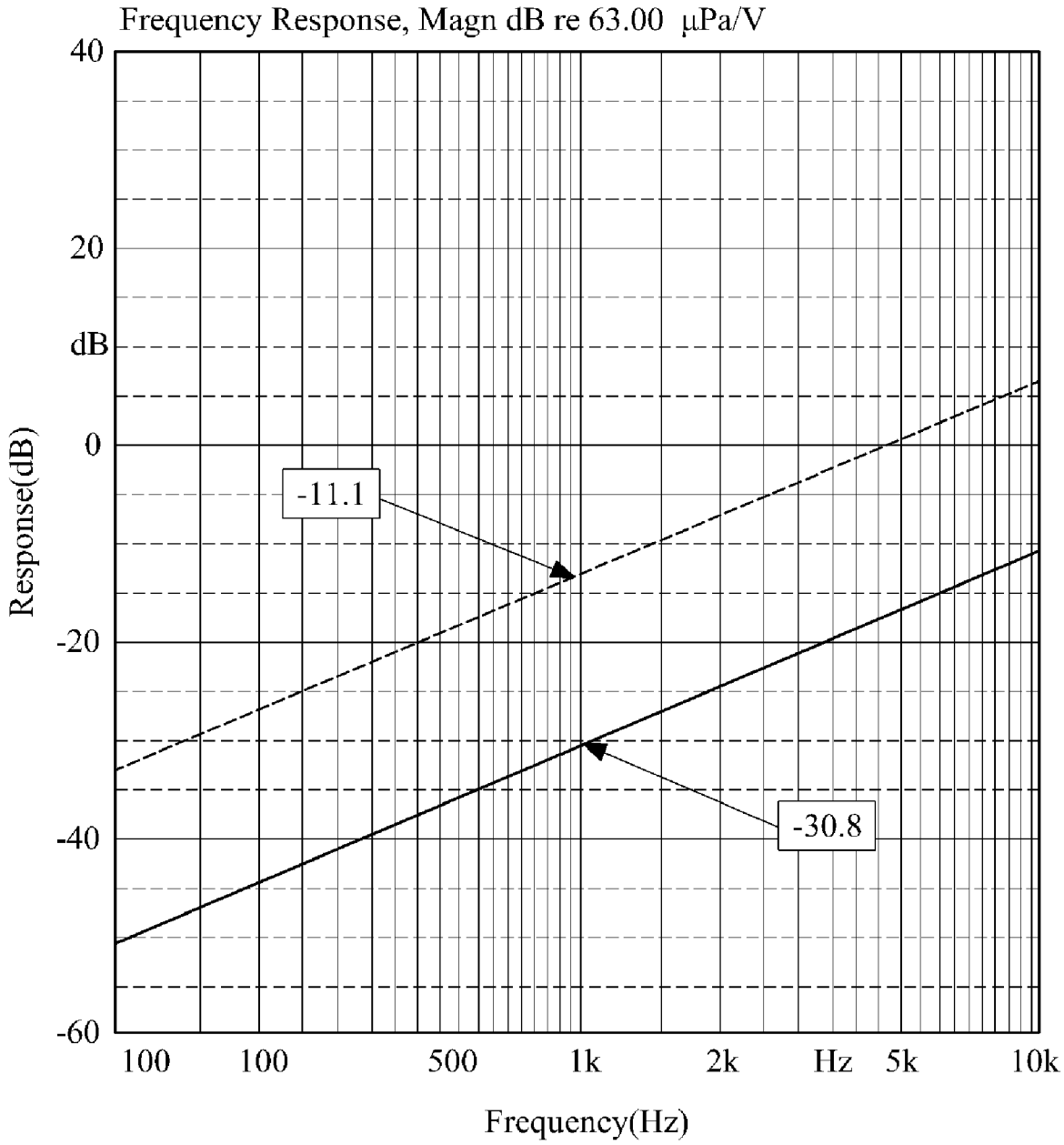
FIGS. 10A and 10B are frequency-response characteristic graphs of an ear speaker in a mobile communication terminal equipped with an IC chip type hearing aid module.
Figure 10B:
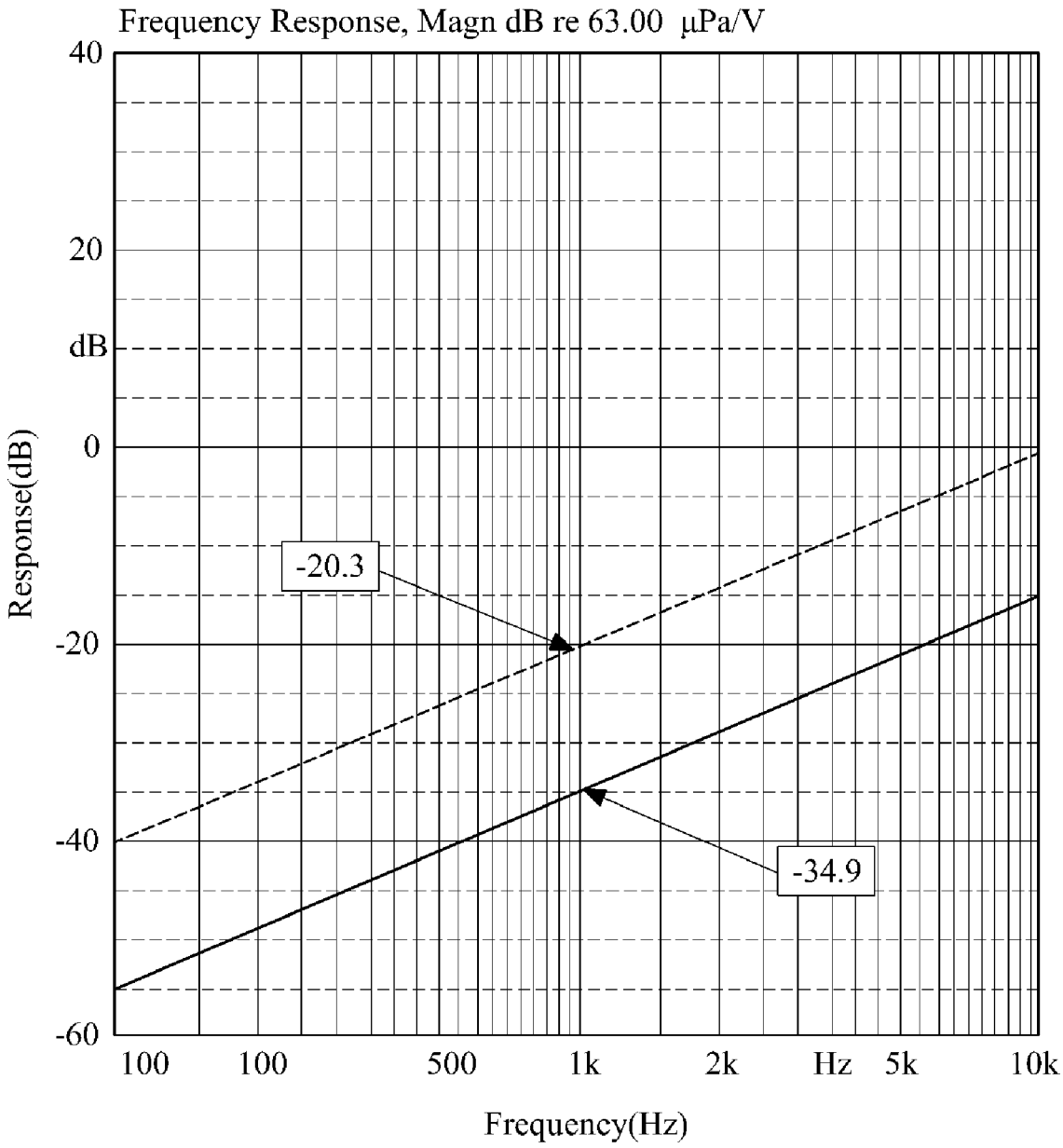

FIGS. 10A and 10B are frequency-response characteristic graphs of an ear speaker in a mobile communication terminal equipped with an IC chip type hearing aid module.

FIG. 10A illustrates a magnetic intensity in an axial direction. In the drawing, a dotted line represents a graph when an exemplary embodiment of the present invention is applied, and a solid line represents a graph when the exemplary embodiment of the present invention is not applied. As can be seen in the drawing, a magnetic intensity is −14.1 dB at a frequency of 1 kHz when the exemplary embodiment of the present invention is applied, while the magnetic intensity is −30.8 dB at the same frequency when the exemplary embodiment of the present invention is not applied. That is, according to the exemplary embodiment of the present invention, the magnetic intensity is increased.

FIG. 10B illustrates a magnetic intensity in a radial direction. In the drawing, a dotted line represents a graph when the exemplary embodiment of the present invention is applied, and a solid line represents a graph when the exemplary embodiment of the present invention is not applied. As can be seen in the drawing, a magnetic intensity is −20.3 dB at a frequency of 1 kHz when the exemplary embodiment of the present invention is applied, while the magnetic intensity is −34.9 dB at the same frequency when the exemplary embodiment of the present invention is not applied. That is, according to the exemplary embodiment of the present invention, the magnetic intensity is increased.

As apparent from the above description, the IC chip type hearing aid module for use in the mobile communication terminal allows the hard-of-hearing to hear an audio signal from the mobile communication terminal better. In addition, the IC chip type hearing aid module is easy to be applied to the mobile communication terminal. Further, the gain of an output signal can be adjusted according to the degree of hardness of hearing so that general users, the hard-of-hearing, and the very-hard-of-hearing can hear the audio signal better.

While the present invention has been described with reference to exemplary embodiments thereof, it will be understood by those skilled in the art that various changes in form and details may be made therein without departing from the scope of the present invention as defined by the following claims and their equivalents.

What is claimed is:

1. An IC (integrated circuit) chip type hearing aid module having a hearing aid circuit, comprising:

a first section to increase a magnetic intensity produced in an ear speaker, and connected in series on a first output line between a mobile communication terminal and the ear speaker;

a second section to increase a magnetic intensity produced in the ear speaker, and connected in series on a second output line between the mobile communication terminal and the ear speaker;

a third section to compensate a tolerance generated by mutual interference between the second section and the first section, and connected in series between an input terminal of the first section and an output terminal of the second section; and a fourth section to compensate a tolerance generated by mutual interference between the second section and the first section, and connected in series between an input terminal of the second section and an output terminal of the first section.

2. The IC chip type hearing aid module of claim 1, wherein the third section and the fourth section transmit an AC audio signal while blocking a DC signal.

3. The IC chip type hearing aid module of claim 1, wherein the hearing aid circuit further comprises a filter which is connected between the output terminals and/or the input terminals of the first and second sections.

4. The IC chip type hearing aid module of claim 1, further comprising noise removing sections which are connected to the output terminals or input terminals of the first and second sections.

5. The IC chip type hearing aid module of claim 1, further comprising a gain adjusting section which is connected to the input terminals of both the first and second sections and outputs a signal amplified through an induction loop amplification operation according to the gain setting from a user.

6. The IC chip type hearing aid module of claim 5, wherein the gain adjusting section comprises:

a plurality of switches for gain setting;

two amplifiers each having two input terminals and an output terminal, the output terminals being connected to the input terminals of the first and second sections, a non-inverting one of the input terminals of one of the amplifiers and an inverting one of the input terminals of the other amplifier being connected to a ground terminal, and the switches being connected in parallel between the remaining input terminals of the amplifiers and the output terminals of the amplifiers; and a plurality of resistors which are connected between the switches and the output terminals of the two amplifiers.

7. The IC chip type hearing aid module of claim 6, wherein the gain adjusting section further comprises impedance adjusting sections, each of which comprises a capacitor and a resistor connected in series and which are respectively connected to the input terminals of the two amplifiers which have different polarities from each other.

8. The IC chip type hearing aid module of claim 1, further comprising switches which are respectively connected to the output terminals of both the first and second sections to connect/disconnect between the hearing aid circuit and the ear speaker.

9. An electric device equipped with the IC chip type hearing aid module of claim 1.

* * * * *